US008264810B2

(12) United States Patent
Wellner et al.

(10) Patent No.: US 8,264,810 B2
(45) Date of Patent: Sep. 11, 2012

(54) ELECTRICALLY ASSISTED SAFING OF A LINEAR ACTUATOR TO PROVIDE SHOCK TOLERANCE

(75) Inventors: Edward L. Wellner, Colgate, WI (US); Alvin R. Zemlicka, Elkhart Lake, WI (US); Richard F. Schmerda, West Allis, WI (US)

(73) Assignee: DRS Power & Control Technologies, Inc., Milwaukee, WI (US)

( * ) Notice: Subject to any disclaimer, the term of this patent is extended or adjusted under 35 U.S.C. 154(b) by 299 days.

(21) Appl. No.: 12/572,209

(22) Filed: Oct. 1, 2009

(65) Prior Publication Data

US 2011/0080685 A1 Apr. 7, 2011

(51) Int. Cl.
*H01H 9/00* (2006.01)

(52) U.S. Cl. ..... 361/139; 361/160

(58) Field of Classification Search ..... 361/139, 361/160

See application file for complete search history.

(56) References Cited

U.S. PATENT DOCUMENTS

| | | | | |
|---|---|---|---|---|
| 3,740,738 | A | 6/1973 | Kosanovich et al. | |
| 4,370,635 | A | 1/1983 | Carroll et al. | |
| 4,631,624 | A | 12/1986 | Dvorak et al. | |
| 4,710,739 | A | 12/1987 | Heyne et al. | |
| 4,845,464 | A | 7/1989 | Drori et al. | |
| 5,394,142 | A | 2/1995 | Dusart | |
| 5,797,360 | A * | 8/1998 | Pischinger et al. | 123/90.11 |
| 6,138,516 | A | 10/2000 | Tillman | |
| 6,255,924 | B1 | 7/2001 | Turner et al. | |
| 6,317,308 | B1 | 11/2001 | Durif et al. | |
| 6,388,859 | B1 | 5/2002 | Turner et al. | |
| 6,486,758 | B1 | 11/2002 | Olszewski et al. | |
| 7,064,634 | B1 | 6/2006 | Wehrli, III et al. | |
| 7,369,021 | B2 | 5/2008 | Bogdon et al. | |
| 7,486,164 | B2 | 2/2009 | Sisley et al. | |
| 2003/0179534 | A1 | 9/2003 | Hermann et al. | |
| 2005/0078428 | A1 | 4/2005 | Titschert et al. | |

FOREIGN PATENT DOCUMENTS

| | | |
|---|---|---|
| WO | WO95/32536 | 11/1995 |
| WO | WO01/86776 | 11/2001 |

OTHER PUBLICATIONS

International Search Report corresponding to PCT/US10/050817 dated Nov. 23, 2010.

Wellner, Edward, et al., "Novel Undervoltage Release Concept", Presented at Electric Ship Technologies Symposium, 2009-ESTS 2009, IEEE, Apr. 20-22, 2009.

Naval Ships' Technical Manual—"Electric Motors and Controllers", Chapter 302-3.2.7.2.2; 302.3.2.7.3; 302.3.2.7.3.1-2; pp. 23-25; Sep. 1, 1999.

* cited by examiner

*Primary Examiner* — Danny Nguyen

(74) *Attorney, Agent, or Firm* — Kilpatrick Townsend & Stockton LLP

(57) ABSTRACT

Electrically assisted safing of a solenoid linear actuator to provide shock tolerance is provided for a solenoid actuator, the actuator having an armature and at least one electromagnetic inductive coil. A controller, receiving an output from a motion sensor, adjusts an electrical power input to the electromagnetic inductive coil. When the output of the motion sensor indicates onset of an environmental transient exceeding a predetermined threshold of intensity, the controller adjusts the electrical power input such that an electromagnetic field generated by the coil is sufficient to restrain the armature in a desired position during the environmental transient.

20 Claims, 6 Drawing Sheets

ELECTRICALLY ASSISTED SAFING OF A LINEAR ACTUATOR TO PROVIDE SHOCK TOLERANCE

FIELD OF THE INVENTION

The present invention relates generally to shock tolerant linear actuators, and, more particularly, to a linear actuator that is electrically safed upon the onset of an environmental transient such as a shock event.

BACKGROUND OF THE INVENTION

The assignee of the instant patent application provides power distribution equipment meeting the military requirements of, for example, the U.S. Navy. The power distribution equipment includes electro-mechanical devices such as circuit breakers that must reliably operate in the face of large and unpredictable mechanical shocks and related environmental transients.

Circuit breakers are frequently equipped with undervoltage release (UVR) mechanisms. A UVR mechanically trips the circuit breaker to the open position, when an undervoltage event occurs. A UVR may be added to a circuit breaker for a number of reasons. For example, a UVR may provide protection for an electrical system which employs dual power inputs by opening a breaker associated with a power source that is off-line to prevent power back-feeding into that source from an on-line power source. Another possible application of a UVR is to provide an inexpensive type of coordination of the breakers. A UVR in a branch breaker will open that breaker when the main breaker trips, thus assuring that when power is restored, that branch breaker will remain open until some required action is taken.

The UVR must reliably trip the circuit breaker upon an onset of a specified low voltage condition, but must also be relied upon to avoid inadvertently tripping the circuit breaker as a result, for example, of a mechanical shock. Because a UVR must trip the breaker when there is no power in the system, the energy required to trip the breaker must be stored. This may be accomplished by storing energy in a helical coil spring, for example.

A conventional UVR, illustrated in FIG. 1, may include a linear actuator 1 employing a solenoid having a magnetically permeable armature 12, and an electromagnetic inductive coil 15. Coil 15 is wound about a magnetically permeable, cylindrical annular core 16 secured within frame 17. The interior of core 16 is sized to receive armature 12 and permit axial motion of armature 12. A helical coil spring 13 may be provided to bias the armature 12 in an extended position such that, in the absence of a countervailing force, the armature end 23 engages a circuit breaker trip button 27.

When a requisite amount of voltage ("holding voltage") is provided to coil 15 by a power supply (not shown), the armature 12 is held in a retracted position by an electromagnetic field generated by coil 15, and armature end 23 is separated by some distance from trip button 27. When current is removed from coil 15, or the voltage from the power supply drops below the requisite holding voltage, the electromagnetic field becomes insufficient to overcome the bias provided by spring 13, whereupon the armature 12 moves to the extended position and armature 23 engages trip button 27.

The actuator described in general terms above, and many variants thereof, are well known in the art to be particularly sensitive to dynamic loads resulting from mechanical shock or vibration. This sensitivity results from the intersection of competing design imperatives. On the one hand, upon occurrence of an undervoltage event, armature 12 must be driven by spring 13 a sufficient distance, and with sufficient force, to successfully actuate trip button 27. On the other hand, the power required to hold armature 12 in the retracted position must be minimized in order to avoid, for example, unnecessary heating of coil 15. Thus, efficient designs provide that the normal holding voltage provided to coil 15 has minimal margin over that required to overcome the bias provided by spring 13. This presents a problem when mechanical load transients are encountered, because a relatively small shock pulse, for example, can cause armature 12 to start to move from the retracted position. Once that occurs, energy stored in spring 13 can easily cause actuator 1 to inadvertently and inappropriately actuate trip button 27.

The foregoing problem has been widely recognized in the art, and several methods directed toward mitigating it have been proposed.

One approach, disclosed in U.S. Pat. No. 6,317,308, proposes to detect an unscheduled movement of armature 12, by observing a change in value of current flowing in coil 15, the change in value resulting from electromotive force caused by the movement. Upon registering the change in value, a holding current to coil 15 is increased, with the objective of stopping or reversing the unscheduled movement, before an inappropriate actuation of trip button 27 occurs. But, since the holding current may only be increased after some measurable unscheduled movement occurs, there is a problem to mitigate the risk that the counteracting increase in holding current will be too late or of insufficient strength.

Other techniques, exemplified by U.S. Pat. Nos. 6,255,924, 6,486,758, and 7,486,164, for example, propose various additions to the basic linear actuator, intended to decrease its sensitivity to mechanical load transients. As proposed in U.S. Pat. No. 6,255,924, for example, resilient shock mounts are provided. U.S. Pat. No. 6,486,758 discloses an "inertial lock" that mechanically safes the linear actuator in the event of a shock event. U.S. Pat. No. 7,486,164 discloses various anti-shock devices intended to mechanically prevent movement of an armature in the face of a mechanical shock.

While the foregoing approaches mitigate to some extent the immediate problem of inappropriate actuation upon occurrence of an environmental transient, they increase the complexity, size and cost of the mechanism and/or may not be sufficient for severe military environments.

Accordingly, there is a long felt need for improved, acceptably shock tolerant UVR's, and similar linear actuators, that avoid the disadvantages of the known techniques.

SUMMARY OF THE INVENTION

The present inventors have recognized that adverse effects from shock sensitivity of linear actuators such as under voltage release mechanisms may be substantially eliminated by electrically safing the actuator upon a detected onset of an environmental transient such as a shock or vibration event.

In an embodiment, an apparatus includes a solenoid actuator having an armature and at least one electromagnetic inductive coil, each coil having an electrical power input; a motion sensor; and a controller, coupled to the motion sensor and receiving an output therefrom, that adjusts the electrical power input to said coil. When the output of the motion sensor indicates onset of an environmental transient exceeding a predetermined threshold of intensity, the controller adjusts the electrical power input such that an electromagnetic field generated by the coil is sufficient to restrain the armature in a desired position during the environmental transient.

In a further embodiment, the solenoid actuator has a first and a second electromagnetic inductive coil. The first electromagnetic coil may be a pull-in coil; the second electromagnetic coil may be a holding coil; and when the output of the motion sensor indicates onset of an environmental transient, the controller adjusts the electrical power input by energizing the pull-in coil.

In another embodiment, the motion sensor is an accelerometer, a vibration sensor, and/or a shock sensor. The environmental transient may be a shock, and/or a vibration.

In an embodiment, the controller adjusts the electrical power input by increasing the input voltage and/or input current.

In a further embodiment, the electromagnetic field generated by the coil is sufficient to overcome a mechanical counterforce. The mechanical counterforce may be provided by a spring, which may be a helical coil spring.

In yet another embodiment, the armature is mechanically counter-balanced to reduce relative motion between the armature and the electromagnetic inductive coil resulting from the environmental transient.

In an embodiment, the controller adjusts the electrical power for a time period set to exceed a duration of the environmental event by a predetermined margin.

In a further embodiment, the controller adjusts the electrical power with a rise time substantially similar to a rise time of the environmental transient.

In yet a further embodiment, an apparatus includes a solenoid actuator having an armature and at least one electromagnetic inductive coil, each coil having an electrical power input; an accelerometer; and a controller, coupled to the accelerometer and receiving an output therefrom, that adjusts the electrical power input to said coil. When the output of the accelerometer indicates onset of an environmental transient exceeding a predetermined threshold of intensity, the controller adjusts the electrical power input such that an electromagnetic field generated by the coil is sufficient to restrain the armature in a desired position during the environmental transient.

In an embodiment, the solenoid actuator is a component of an undervoltage release mechanism.

In a further embodiment, an apparatus includes a circuit breaker and an undervoltage release mechanism operable to trip said circuit breaker upon occurrence of an undervoltage event. The undervoltage release mechanism includes a solenoid actuator having an armature and at least one electromagnetic inductive coil; an accelerometer; and a controller, coupled to the accelerometer and receiving an output therefrom, that adjusts an electrical power input to said coil. When the output of the accelerometer indicates onset of an environmental transient exceeding a predetermined threshold of intensity, the controller adjusts the electrical power input such that an electromagnetic field generated by the coil is sufficient to restrain the armature in a desired position during the environmental transient.

DETAILED DESCRIPTION

Figure 1:
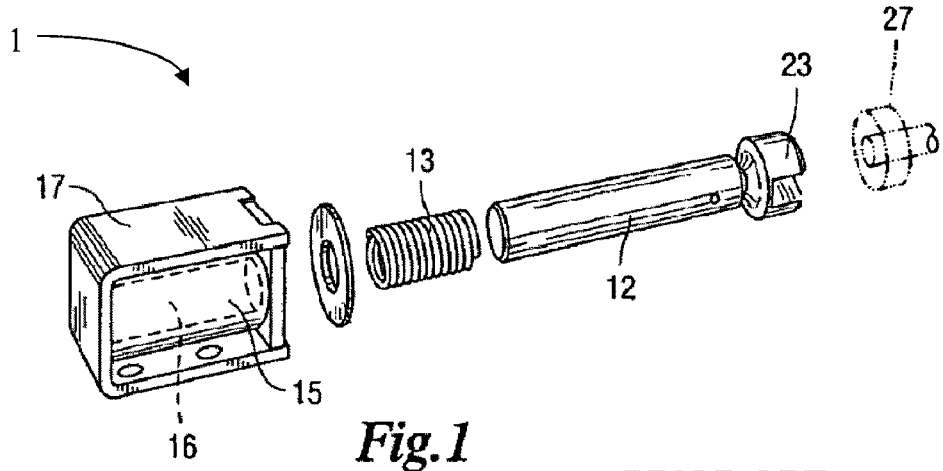
Fig.1 PRIOR ART
FIG. 1 shows an exploded isometric view of a linear actuator known in the prior art.

Disclosed herein is an apparatus and method whereby a solenoid actuator may be electrically safed upon detection of onset of an environmental transient. In an embodiment illustrated in FIG. 2, an actuator 201 may be electrically coupled to, for example, power supply 202 so as to receive an electrical power input 222 which is adjustable by a controller 203. Actuator 201 may be a conventional linear actuator as described above in reference to FIG. 1, or any variant thereof, provided that the actuator has a magnetically permeable armature that translates with respect to the actuator body, and at least one electromagnetic coil operable to induce a magnetic field capable of impeding the armature movement.

Controller 203, upon receiving an output 224 from motion sensor 204 that indicates onset of an environmental transient exceeding some predetermined threshold, may adjust electrical power input 222 such that an electromagnetic field generated by the actuator coil is sufficient to "safe" actuator 201. As the term is used herein, "safe" means that unwanted motion of the actuator's armature with respect to the actuator body is substantially suppressed, such that the armature is restrained in a desired position. As discussed in more detail hereinbelow, the inventors have found that a signal processing time during which (1) an environmental transient may be sensed, and, (2) in reaction to which the power supply parameter may be adjusted, is short enough that unwanted motion of the armature can be substantially suppressed. More particularly, for example, an embodiment provides for a rise time in the electrical power input to the coil that is substantially similar to a rise time of the environmental transient.

Advantageously, electrical power input 222 remains adjusted as long as the environmental transient exceeds a predetermined threshold. In an embodiment, electrical power input 222 remains adjusted for a period exceeding a duration of the environmental transient. Advantageously, the period may be selected based on characteristics of the coil. For example, the period may be selected to ensure that an increased current to the coil does not result in overheating of the coil.

As known in the art, actuator 201 may have one, two, or more electromagnetic coils. In an embodiment, actuator 201 may have a single coil, in which case, electrical power input 222 to be adjusted may be input voltage, current and/or power provided to the single coil. For example, if input 222 is a current, upon receiving signal 224 indicative of an onset of an environmental transient, controller 203 may adjust input 222 by increasing the current, thereby increasing the strength of the field generated by the electromagnetic coil of actuator 201.

In a further embodiment, actuator 201 may have a first, low power, "holding" coil, and a second, higher power, "pull-in" coil. Conventionally, the "pull-in" coil is only energized when it is desired to translate (pull-in) the armature from the extended position to the retracted position. In such case, electrical power input 222 may be an input voltage, current and/or power provided to the pull-in coil. For example, if input 222 is a current, upon receiving signal 224 indicative of an onset of an environmental transient, controller 203 may adjust input 222 by energizing a pull-in coil, thereby providing a stronger magnetic field than that generated by the holding coil of actuator 201 operating alone. Advantageously, the pull-in coil is energized as long as the environmental transient exceeds a predetermined threshold.

Motion sensor 204 may be a conventional accelerometer, vibration sensor or shock sensor. Alternatively, motion sensor 204 may be custom designed to provide predetermined response characteristics. Output signal 224 may be adopted to signify various environmental transients such as shock and/or vibration.

As discussed hereinabove, actuator 201 may include a helical spring or other mechanical means providing a counterforce by which the armature is biased in, for example, the extended position. In such case, advantageously, the magnetic field generated by the electromagnetic coil is sufficient to overcome the mechanical counterforce.

Figure 2A:
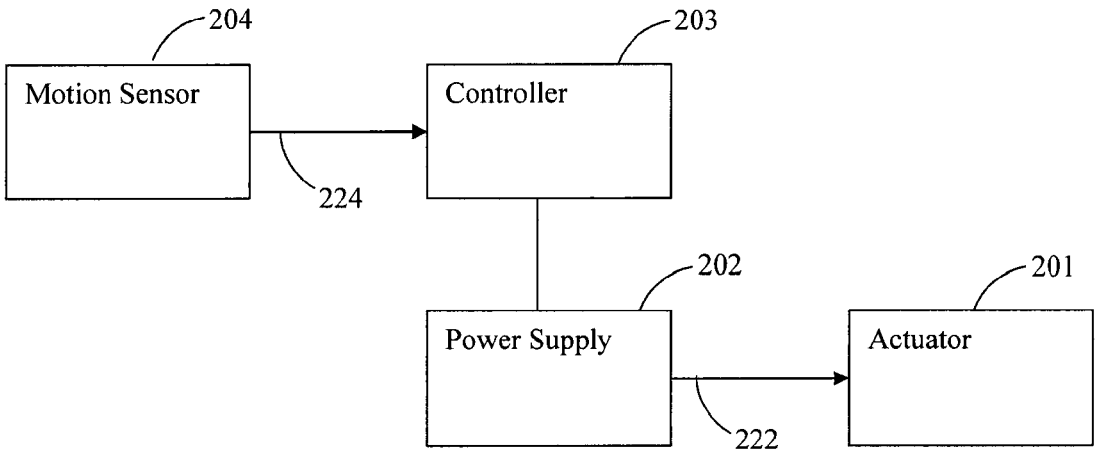
FIG. 2*a* shows a functional block diagram of an embodiment.

It will be understood that the embodiment illustrated in FIG. 2*a* is merely an exemplary technique for providing a controller coupled to a motion sensor and controlling an electrical power input to an actuator coil. In this embodiment, controller 203 is shown disposed between motion sensor 204 and power supply 202. Controller 203 and power supply 202, however, may be disposed in various manners, or be integrated as a single unit.

Figure 2B:
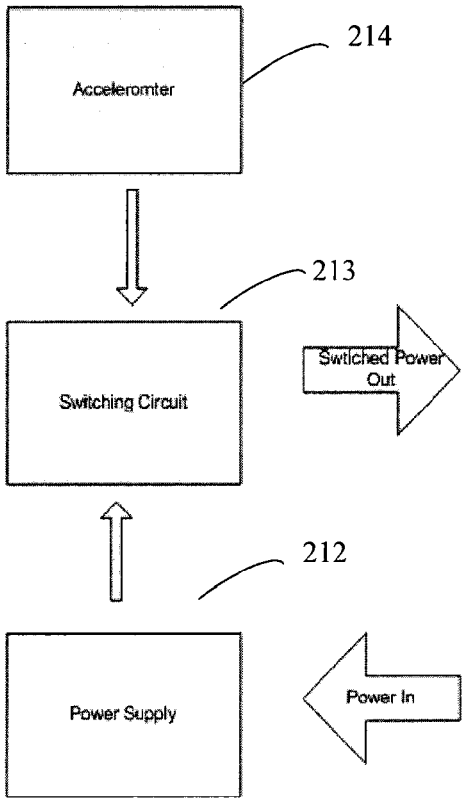
FIG. 2*b* shows a functional block diagram of an embodiment.

For example, as illustrated in FIG. 2*b*, a controller may be embodied as a switching circuit 213, operating on inputs from a motion sensor (accelerometer 214) and a power supply 212. Power supply 212 may include a voltage converter for providing a low voltage to switching circuit 213. Onset of an acceleration may be sensed by accelerometer 214 a signal representative thereof fed to switching circuit 213. When the signal exceeds a predetermined threshold, switching circuit 213 may adjust an electrical power input to an electromagnetic coil of an actuator (not shown).

Figure 3:
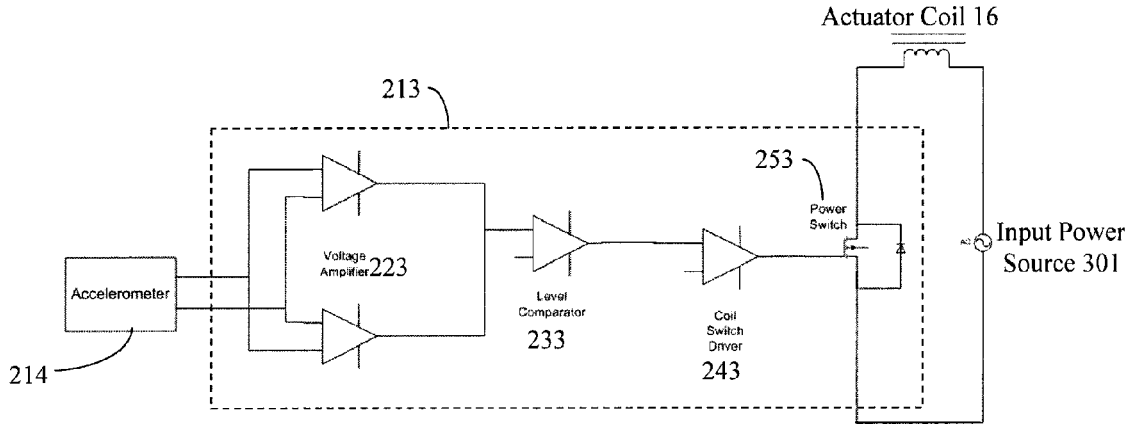
FIG. 3 shows an electrical block diagram of an embodiment.
Figure 4:
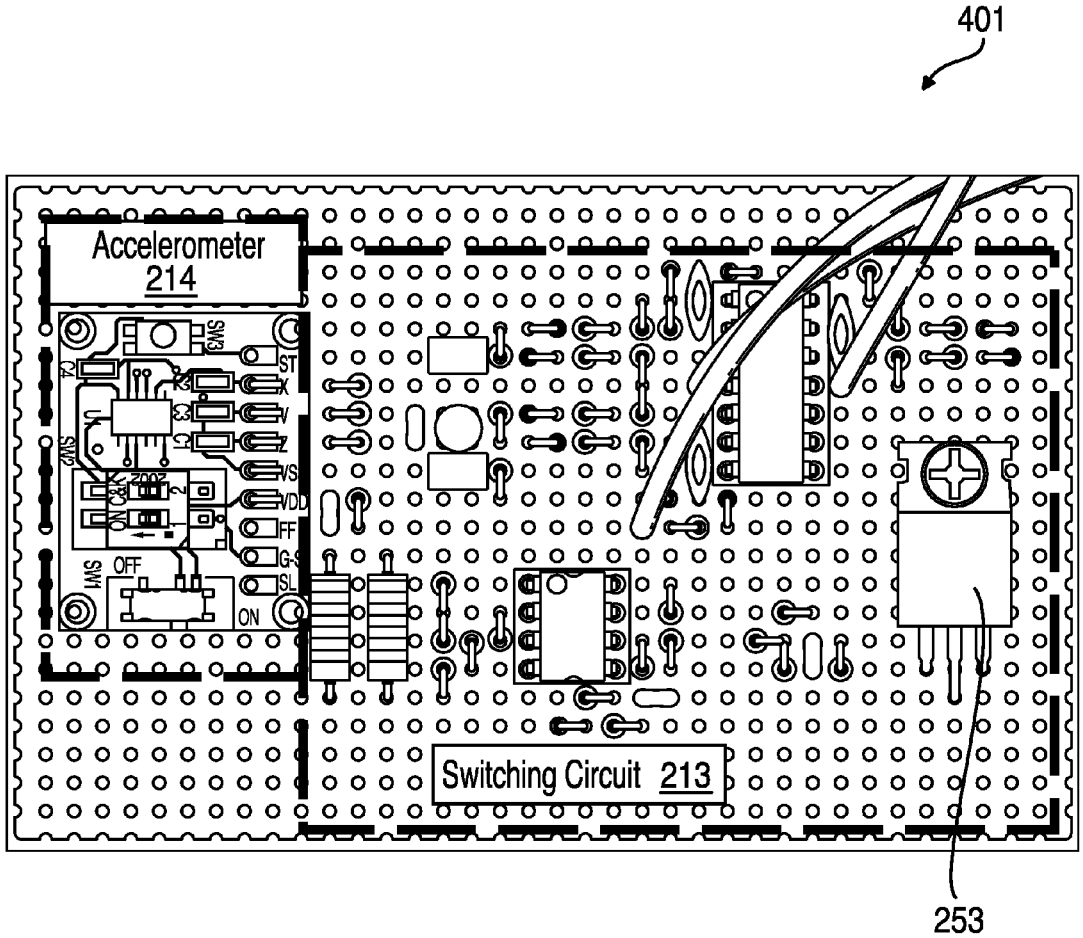
FIG. 4 shows an accelerometer and switching circuit suitable for use in an embodiment.

Referring now to FIG. 3, an electrical block diagram of an embodiment will be described in additional detail. Switching circuit 213 may include a voltage amplifier 223, a level comparator 233, a coil switch driver 243 and a power switch 253. FIG. 4 illustrates a breadboard apparatus embodiment 401 of a suitable switching circuit 213 together with a known accelerometer 214.

An output signal from accelerometer 214 may be received and amplified by voltage amplifier 223. A resulting output signal from voltage amplifier 223 may be processed by level comparator 233 to determine whether the output signal from accelerometer 214 is indicative of an environmental transient exceeding a predetermined threshold of intensity. When a determination is made by level comparator 233 that the output signal from accelerometer 214 is indicative of an environmental transient exceeding the predetermined threshold of intensity, a signal from level comparator 233 may cause coil switch driver 243 to initiate control of power switch 253.

Power switch 253 may advantageously be disposed in series with input power source 301 and actuator coil 16. As a result, operation of switching circuit 213 can control the electrical power input to actuator coil 16. In an embodiment, actuator coil 16 is a pull-in coil of a linear actuator.

In an embodiment, accelerometer 214 may be an integrated circuit accelerometer feeding operational amplifiers to take the absolute value and sum the acceleration in all three axes. The foregoing embodiment was found to provide good sensitivity to the shock, precise measurement of the acceleration levels, and convenient adjustability of the predetermined threshold of intensity. Other methods of providing the same function, however, may be employed. For example, a simple shock-sensitive switch may cause a pull-in coil to be energized.

The present inventors have found that an embodiment built according to the foregoing description compares favorably in terms of envelope, mass and cost to previously known techniques for mitigating the shock sensitivity of a linear actuator.

Figure 5:
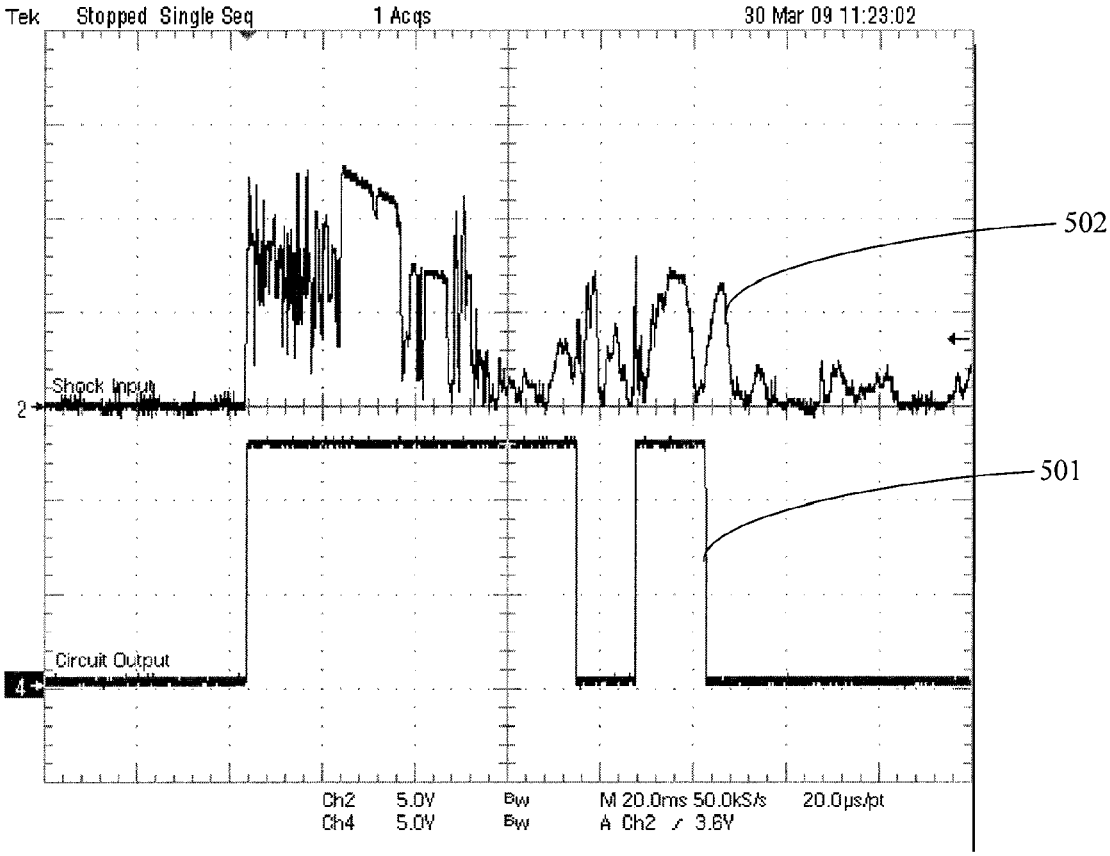
FIG. 5 shows test results comparing a response time of an embodiment with a rise time of an environmental shock transient.

As noted hereinabove, the present inventors have found that a signal processing time during which (1) an environmental transient may be sensed by, for example, accelerometer 214, and, (2) in reaction to which an electrical power input to an actuator coil may be adjusted by, for example, switching circuit 213, is short enough that unwanted motion of the armature can be substantially suppressed. Referring now to FIG. 5, an output 501 of switching circuit 213 is graphed on a common time axis with a measured shock pulse signal 502 applied to an under voltage release mechanism and to the breadboard apparatus shown in FIG. 4. The measured shock pulse signal 502 resulted from striking a plate, on which both a UVR mechanism and breadboard apparatus 401 were mounted, with a hammer. The hammer strike provided a sufficient shock level to cause the UVR to trip when not safed by switching circuit 213. When switching circuit 213 was enabled to provide electrically assisted safing as described above, however, a rise time in a power input to an actuator coil of the UVR was such that the coil of the UVR prevented the armature from unseating and releasing. As illustrated in FIG. 5, moreover, the rise time of the output of switching circuit 213 is substantially similar to the rise time of the mechanical shock transient.

Figure 6:
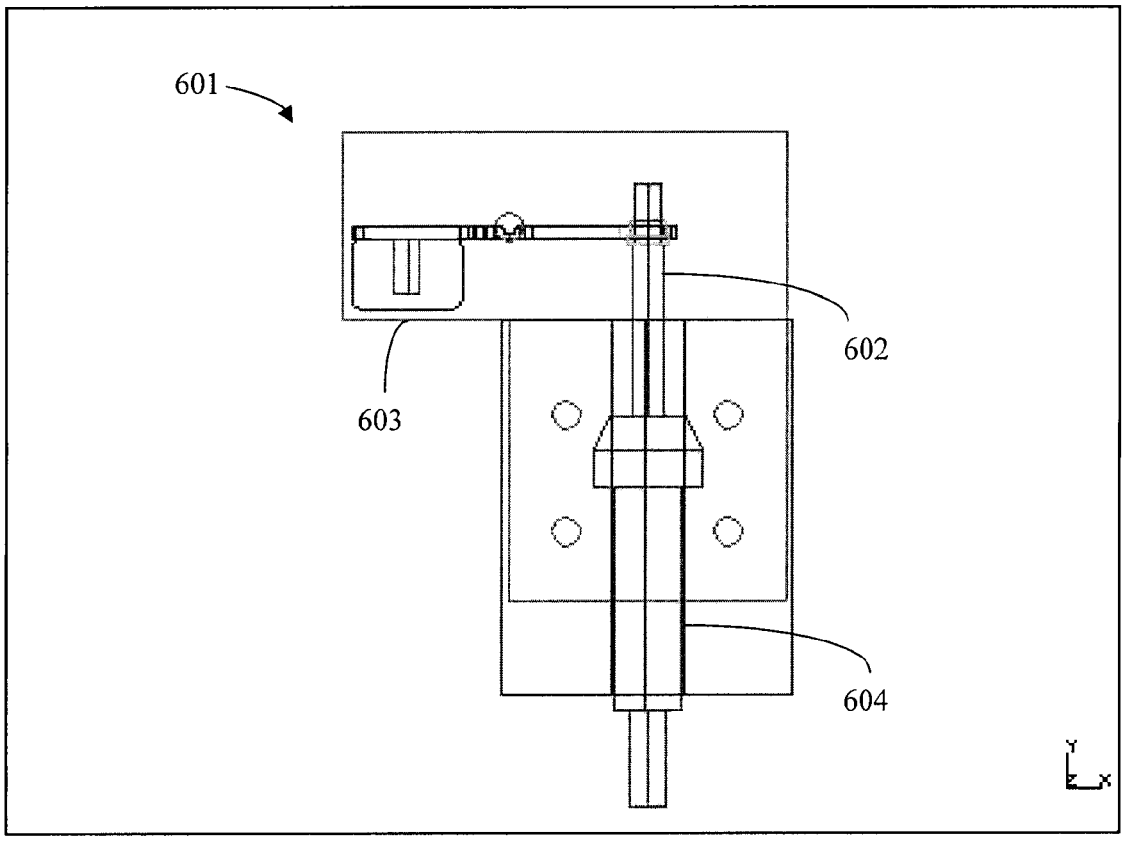
FIG. 6 shows a plan view of an embodiment.

Referring now to FIG. 6, a linear actuator 601, having an armature 602, is illustrated. In the illustrated embodiment, the armature 602 may be linked to a mechanical counter-balance 603 to reduce relative motion between armature 602 and and actuator body 604 that would otherwise result from an environmental transient. Such an embodiment may be implemented in combination with the electrically assisted safing techniques described hereinabove, to relax, for example, requirements imposed on the electrical power input to the actuator electromagnetic inductive coil.

While certain embodiments described herein are advantageously directed toward implementing an improved, shock-tolerant UVR for a circuit breaker, the above described techniques discovered by the present inventors are not limited to such application. For example, the techniques could be applied to a number of other devices which utilize solenoid coils controlling a shock-sensitive actuator, such as contactors, valves, electrical locking devices. The techniques may also be used in other equipment where a solid-state switch would be used to energize an electrical device which "resists" or braces against the effect of a shock pulse or rapid acceleration.

While certain preferred embodiments have been disclosed, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

What is claimed:

1. An apparatus comprising:

a solenoid actuator comprising an armature and at least one electromagnetic inductive coil, each said coil adapted to receive electrical power;

an input for a motion sensor; and a controller, operatively coupled with said motion sensor and configured to receive an output therefrom adapted to adjust the electrical power to said coil, wherein when said output from the motion sensor indicates an onset of an environmental transient exceeding a predetermined threshold of intensity, the controller is adapted to adjust the electrical power such that an electromagnetic field generated by the coil is sufficient to restrain the armature in a desired position during the environmental transient.

2. The apparatus of claim 1, wherein the solenoid actuator comprises a first and a second electromagnetic inductive coil.

3. The apparatus of claim 2, wherein:

the first electromagnetic coil is a pull-in coil;

the second electromagnetic coil is a holding coil; and when said output indicates an onset of an environmental transient, the controller is adapted to adjust the electrical power to energize the pull-in coil.

4. The apparatus of claim 1, wherein the motion sensor is at least one of an accelerometer, a vibration sensor, or a shock sensor.

5. The apparatus of claim 1, wherein the environmental transient is at least one of a shock or a vibration.

6. The apparatus of claim 1, wherein the controller is adapted to adjust the electrical power by increasing at least one of voltage or current to the coil.

7. The apparatus of claim 1, wherein the electromagnetic field generated by the coil is sufficient to overcome a mechanical counterforce.

8. The apparatus of claim 7, wherein the mechanical counterforce is provided by a spring.

9. The apparatus of claim 8, wherein the spring is a helical coil spring.

10. The apparatus of claim 1, wherein the armature is mechanically counter-balanced to reduce relative motion between the armature and the electromagnetic inductive coil resulting from the environmental transient.

11. The apparatus of claim 1, wherein the controller is adapted to adjust the electrical power for a time period set to exceed a duration of the environmental event by a predetermined margin.

12. The apparatus of claim 1, wherein the controller is adapted to adjust the electrical power with a rise time substantially similar to a rise time of the environmental transient.

13. The apparatus of claim 1, wherein the solenoid actuator is a component of an undervoltage release mechanism.

14. An apparatus comprising a circuit breaker;

an undervoltage release mechanism operable to trip said circuit breaker upon occurrence of an undervoltage event, said mechanism comprising a solenoid actuator comprising an armature and at least one electromagnetic inductive coil;

an accelerometer; and a controller, coupled to said accelerometer and receiving an output therefrom, that adjusts electrical power to said coil; wherein, when said output indicates onset of an environmental transient exceeding a predetermined threshold of intensity, the controller adjusts the electrical power such that an electromagnetic field generated by the coil is sufficient to restrain the armature in a desired position during the environmental transient.

15. A solenoid actuator safing controller apparatus comprising:

means for receiving a motion sensor signal from a motion sensor;

a level comparator configured to determine whether the motion sensor signal exceeds a predetermined threshold;

a solenoid coil switch driver; and a power switch, wherein the level comparator is configured to initiate control of the power switch based upon a determination that the motion sensor signal exceeds the predetermined threshold.

16. The controller of claim 15, wherein initiating control of the power switch includes increasing at least one of voltage or current through the power switch.

17. The controller of claim 15, further comprising:

a motion sensor having an output operatively coupled with the means for receiving.

18. The controller of claim 15 further comprising:

a device comprising a solenoid coil, the solenoid coil of the device configured to receive power from the power switch.

19. The controller of claim 18 wherein the device comprising the solenoid coil is selected from the group consisting of a shock-tolerant undervoltage release (UVR) mechanism for a circuit breaker, a contactor, valve, and electrical locking device.

20. The apparatus of claim 15, wherein the level comparator is adapted to retain control of the power switch for a predetermined time margin after the motion sensor signal is below the predetermined threshold.

* * * * *